US006116529A

United States Patent [19]

Fisher, Jr. et al.

[11] Patent Number: 6,116,529

[45] Date of Patent: Sep. 12, 2000

[54] CORN PROCESSOR FOR FORAGE HARVESTER

[76] Inventors: Gideon A. Fisher, Jr., R.D. 2, Box 321, Myerstown, Pa. 17067; Israel S. Beiler, 343 Christiana Pike, Christiana, Pa. 17509

[21] Appl. No.: 09/265,317

[22] Filed: Mar. 9, 1999

Related U.S. Application Data

[60] Provisional application No. 60/081,704, Apr. 15, 1998.

[51] Int. Cl.[7] ..... B02C 21/02

[52] U.S. Cl. ..... 241/101.763; 241/185.5; 241/189.1; 241/222

[58] Field of Search ..... 241/101.2, 101.762, 241/222, 223, 224, 101.763, 189.1, 185.5, 101.742

[56] References Cited

U.S. PATENT DOCUMENTS

| | | | |
|---|---|---|---|
| 4,345,417 | 8/1982 | deBuhr et al. | 241/101.742 X |
| 4,426,043 | 1/1984 | Martenas | 241/101.2 |
| 4,505,434 | 3/1985 | Martenas et al. . | |
| 4,506,840 | 3/1985 | Fagnani, Jr. et al. | 241/101.763 |
| 4,597,253 | 7/1986 | Blumer . | |
| 4,678,129 | 7/1987 | Dallinger | 241/101.742 |
| 4,718,612 | 1/1988 | Zweegers | 241/55 |
| 5,498,207 | 3/1996 | Cappon et al. | 241/101.763 X |
| 5,822,962 | 10/1998 | Wagstaff et al. | 241/101.762 X |
| 5,901,535 | 5/1999 | Duckinghaus et al. | 241/101.763 X |

FOREIGN PATENT DOCUMENTS

| | | |
|---|---|---|
| 3000946 | 7/1980 | Germany . |
| 080483 | 1/1985 | Germany . |
| 3337381 | 4/1985 | Germany . |
| 3345919 | 6/1985 | Germany . |
| 3415488 | 10/1985 | Germany . |
| 182033 | 5/1979 | Hungary . |

*Primary Examiner*—John M. Husar
*Attorney, Agent, or Firm*—Joseph A. Brown Esq.

[57] ABSTRACT

In a pull type forage harvester which travels forwardly in a field to pick up crop material and feed it into a housing having a cutterhead with knives rotatable around a transverse axes. The cutterhead chops the crop material and deposits it in a transverse trough having an auger which carries the crop to a lateral discharge location. The improvement comprises a corn processor adapter to which chopped corn is conveyed over a floor to an upper and a lower roll rotatable on axes parallel to the cutterhead. The rolls form a bite to receive the corn and pass it between them to crush the kernels therein. The upper roll is positioned close to the cutterhead knives and in crop stripping relation thereto. The lower roll is positioned over the auger to hold down chopped corn thrown upwardly out of the trough.

17 Claims, 6 Drawing Sheets

CORN PROCESSOR FOR FORAGE HARVESTER

RELATED APPLICATION

This application claims the benefit of U.S. Provisional Application Ser. No. 60/081/704 filed Apr. 15, 1998.

FIELD OF INVENTION

The present invention relates to pull-type forage harvesters and more particularly to a corn processor adapter to be build into a pull-type forage harvester whereby the machine can be selectively used to harvest hay crops or corn.

BACKGROUND OF INVENTION

A pull-type forage harvester has a wheel supported frame provided with a draw bar or tongue whereby the harvester can be pulled by a tractor in a field having a crop to be gathered. The harvester has a pick-up and infeed whereby the crop is conveyed into a housing. The corn passes over a shear bar into a cutterhead rotatable about an axis transverse to the direction of travel of the harvester. The cutterhead has knives which cooperate with the shear bar to chop the crop fed into the machine.

A common pull-type harvester has a trough downwardly and rearwardly of the cutterhead which receives the cut crop. A conveyor in the trough moves the crop to a blower for discharge into a trailing wagon. The trough is parallel to the axes of the cutterhead. Such a harvester is shown in U.S. Pat. No. 4,426,043.

Pull-type harvesters are generally used to harvest hay crops. Some farmers use them to also harvest corn. However, in harvesting corn, the stalks, leaves and ears of corn are fed with a cutterhead and only a portion of the corn kernels are cracked in the chopping operation. Many of the kernels remain whole. When such corn crop is fed to cows, uncracked kernels are not digested by the animals and end up on the ground in manure. Feed value is lost.

To overcome the problem of uncracked corn kernels, self-propelled forage harvesters have been provided with corn processors. Such processors comprise a pair of rolls spaced apart a distance less than the thickness of a kernel. When the kernels are passed between the rolls, the kernels are cracked. When subsequently fed to animals, the cows digest the kernels. With greater food value, the cows produce more milk.

A self-propelled forage harvester is expensive. The cost is beyond what many farmers can afford. A pull-type harvester is much less expensive. However, generally corn processors have not been provided with pull-type machines. If a pull-type machine is used to harvest corn without processing the kernels, the feed value is limited.

When corn is harvested with a pull-type machine without a corn processor, a large volume of chopped crop is delivered to the trough through which the crop is conveyed to a blower. When an auger or other conveyor operates to convey the crop in the trough, there is a tendency to throw the material upwardly and out of the trough. U.S. Pat. No. 4,506,840 shows the use of a baffle to help hold a chopped crop in a trough and to deflect material downwardly toward an auger.

SUMMARY OF INVENTION

An object of this invention is to provide a corn processor unit or kit that can be built into a pull-type forage harvester so that such harvester can be used to properly harvest corn as well as hay crops.

Another object of the invention is to provide a simplified corn processor unit wherein chopped corn is delivered directly into the bite of two processor rolls with no intermediate structure between the cutterhead knives and the rolls, whereby there is less chance of the unit plugging.

Another object of this invention is to provide a corn processor having an upper roll closely adjacent to the cylinder generated by knives on a cutterhead and having a surface travelling counter to the travel of the cutterhead knives to strip material off of the knives and feed it into the bite between itself and an associated lower roll. The location of the upper roll and its aggressive stripping of the cutterhead allows the operator to set the harvester to cut the corn crop long and without producing plugging of the crop at the bite of the processor rolls.

Another object of this invention is to provide a corn processor for a pull-type harvester wherein a lower roll of a pair of rolls, in addition to cracking corn kernels with a cooperating upper roll, is so located relative to a transverse conveyor that it serves to hold down processed corn as it is conveyed in the trough to a discharge blower.

A further object of this invention is to position upper and lower corn processors rolls in such a relation to the knives on a cutterhead and to a removable floor over which chopped crop is conveyed to a bite between the rolls that the chopped corn is aggressively and positively pulled from a cutterhead by the rolls.

A still further object of this invention is to provide a corn processor kit construction that can be added to or removed from a pull-type forage harvester without substantial design changes in the harvester.

Other objects of this invention will be apparent hereinafter from the following description and the appended claims thereon.

DESCRIPTION OF INVENTION

Figure 1:
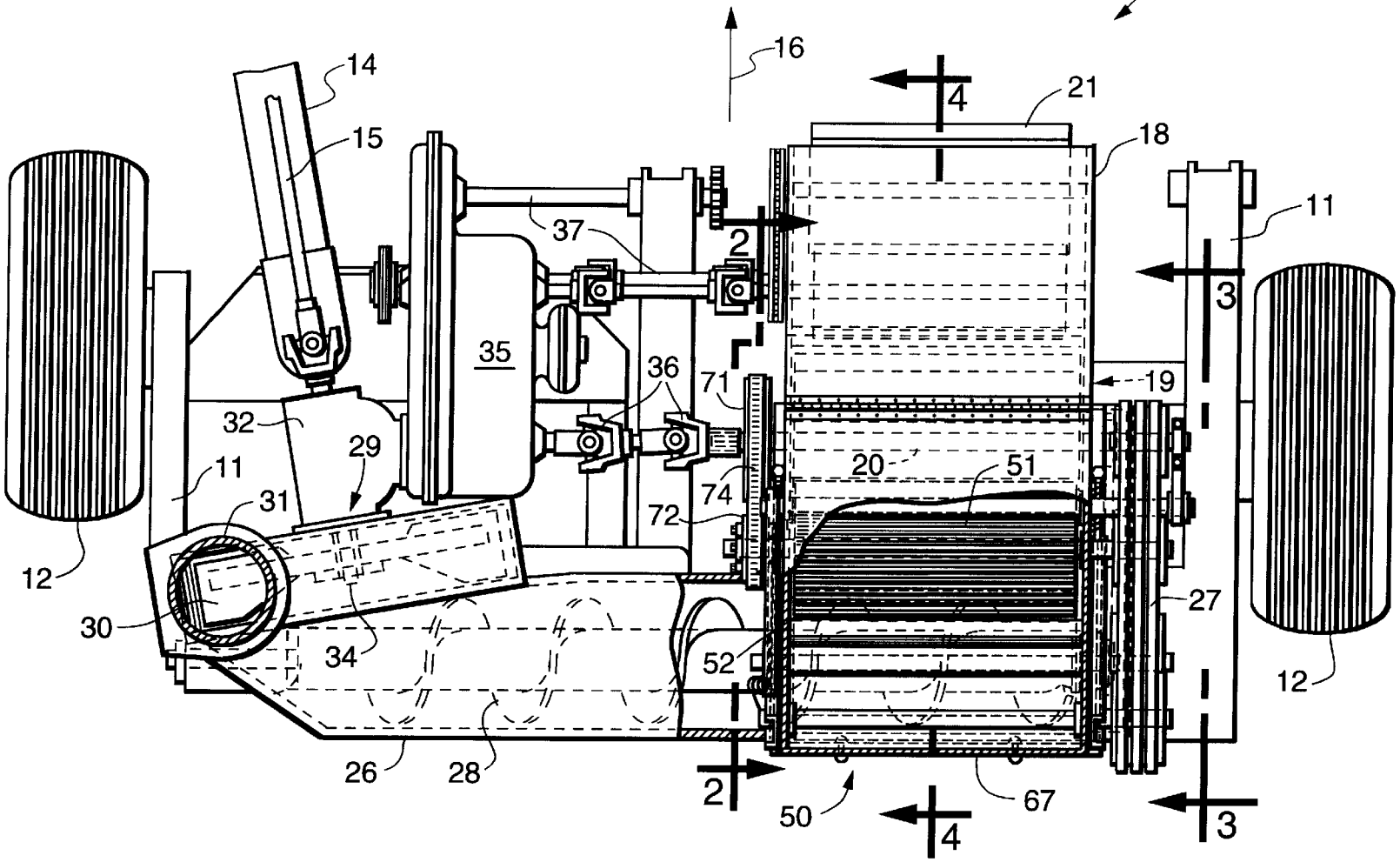
FIG. 1 is a plan view of a forage harvester base unit with a corn processor unit mounted therein constructed according to this invention; a top cover of the unit is broken away to show the processor rolls.

Referring now to the drawings by numerals of reference and first to FIG. 1, 10 denotes a pull-type forage harvester having a frame 11 supported on ground wheels 12. A tongue 14 with a power-take-off drive 15 is adapted to be connected to a tractor which tows harvester 10 in a forward direction indicated by arrow 16.

The harvester has a housing 18 opened forwardly. Mounted on side walls of the housing is a cutterhead 19 having a shaft 20 rotatable on an axes transverse to the direction of travel 16 of the machine. At the front of the harvester there is a header, not shown, which can be a conventional real type pick-up or a row crop which gathers the crop material.

The crop is fed into housing 18 between in-feed rollers 21 (FIG. 4) and over a shear bar 22. The cutterhead has knives 24 mounted around a cylindrical drum 25. The cutting edges of the knives generate a cylinder as the cutterhead rotates. The knives travel for successive cooperation with shear bar 22 to chop the crop material.

Downwardly and rearwardly of cutterhead 19 is a transverse trough 26 carried on the harvester frame 11 and extending from a right side of the harvester facing forwardly to a left side of the machine. Rotatable in the trough is a conveyor 28 in the form of an auger having flights to move chopped crop material to the left side of the machine. The auger is driven by drive belts 27, FIGS. 1 and 3, from the outside right end of shaft 20 of cutterhead 19. Conveyor 28 delivers crop material to a blower 29 having an impeller 30. The impeller discharges the crop upwardly through a spout 31 which directs the crop into a trailing vehicle, such as a wagon, not shown.

Power from the PTO drive shaft 15 is to a main gear box 32, FIG. 1. A shaft 34 from the gear box drives the impeller 30 of the blower 29. The gear box also provides power to an auxiliary gear box 35 having out-put drive elements 36 to the shaft 20 of the cutterhead 19. The drive element 36 connected to shaft 20 is a detachable conventional splined type. Other drive elements 37 operate the infeed rolls 21 and the header of the harvester.

Figure 4:
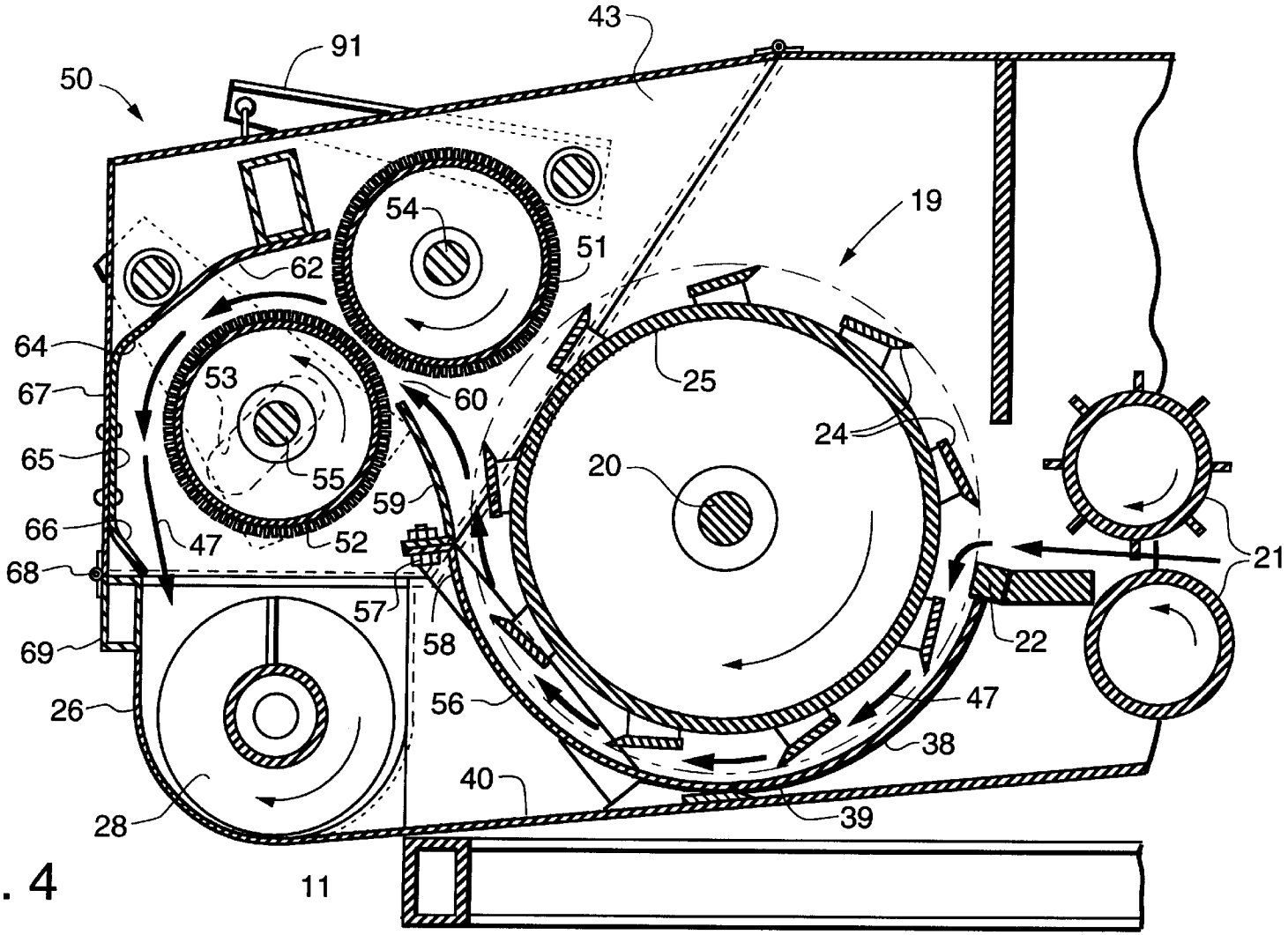
FIG. 4 is a vertical section taken on the line 4—4 of FIG. 1 between FIGS. 2 and 3 showing the corn processor with the removable floor installed to process corn; the position of the top roll relative to the harvester cutterhead; and the location of the lower roll relative to the auger-trough of the machine.

Extending from shear bar 22 to a location below the circle generated by the knives 24 on cutterhead 19 is a fixed floor section 38 (FIG. 4). Floor 38 is on the same arc as the knives. From the lower end 39 of floor 38, there is a ramp or floor section 40 which extends downwardly and rearwardly to auger conveyor 28.

Figure 5:
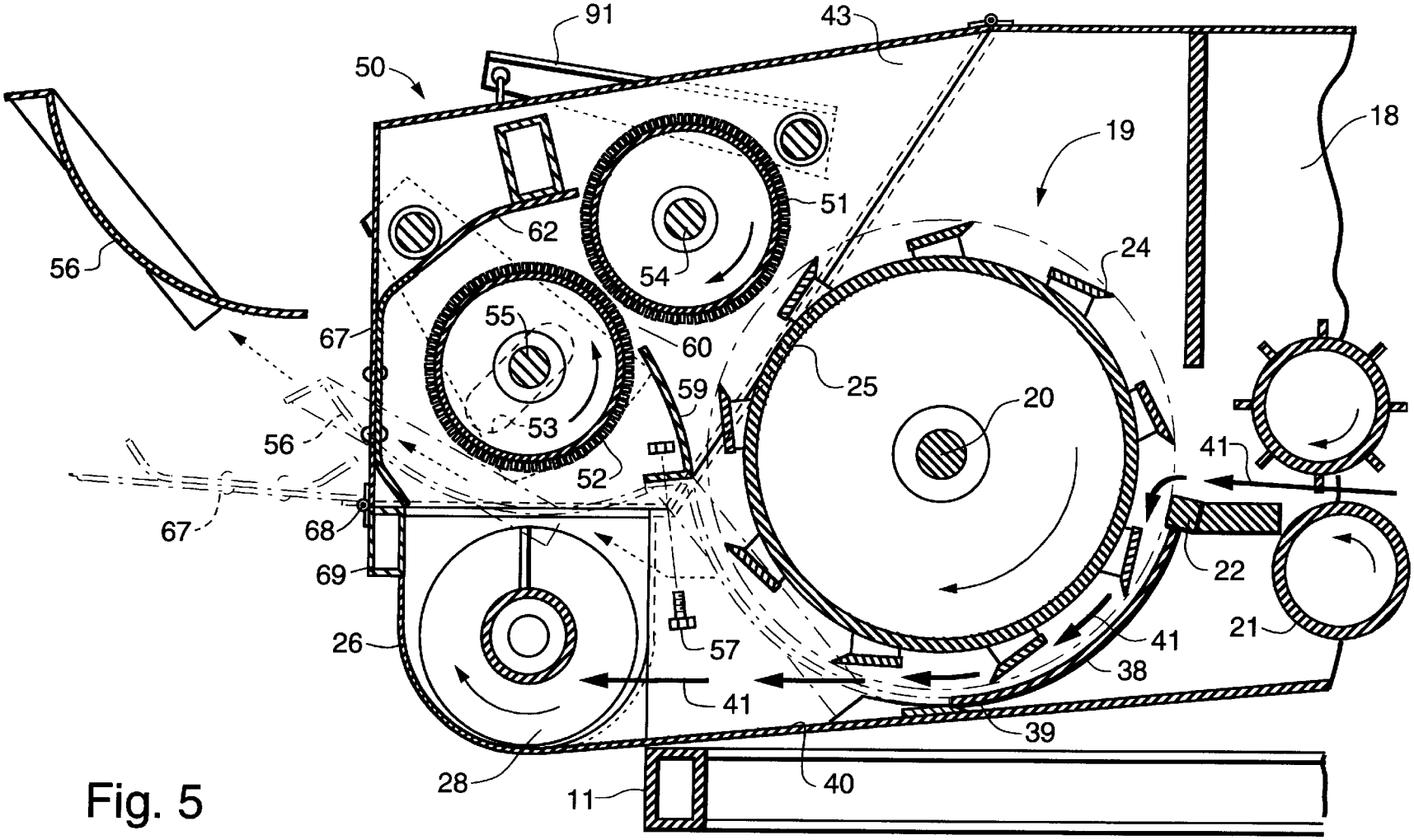
FIG. 5 is a view like FIG. 4 with a floor section of the corn processor removed when hay is being harvested, with the crop material being delivered after chopping by the cutterhead directly to the discharge trough without passing through the corn processor rolls. A back door of the unit is shown in dotted opened position and a floor section of the corn processor is shown removed through the back door.

When hay crops are harvested, FIG. 5, the crop material enters housing 18 between rollers 21 to shear bar 22. The cutterhead knives 24 chop the crop which is then swept downwardly and rearwardly over the curved floor section 38. The crop continues over floor 40 to the auger conveyor 28 for lateral transport in trough 26 to blower 29. The arrows 41 in FIG. 5 show the path of travel of the chopped crop when hay is harvested.

When a corn crop is to be harvested, a corn processor adapter kit 50 is provided constructed according to this invention. It comprises an upper roll 51 and a lower roll 52. Upper roll 51 has a cross shaft 54 and lower roll a cross shaft 55 mounted on the side walls 53 of the processor. Rolls 51 and 52 have a diameter of around eight inches. Both rolls have an aggressive outer surface and they are spaced such a distance that when chopped corn is fed between them the kernels of the corn are cracked. Upper roll shaft 54 rotates in fixed location. Lower roll 52 is mounted so that its shaft 55 can move in side slots 53 away from roll 51 when an overload of crop material occurs.

Corn processor 50 is provided with a removable floor section 56 curved on the same arc as the knives 24 of cutterhead 19 and extending upwardly and rearwardly from the lower rearward end of fixed floor 38. Floor 56 closely follows the path of the knives 24 on the cutterhead. At its upward rearward end 58, removable floor 56 is connected by bolts 57 to a second fixed floor section 59. Floor 59 extends upwardly and away from the cutterhead knives into an inlet bite 60 between the two rolls 51 and 52.

With floor sections 38, 56 and 59 in place, a continuous floor is provided from the shear bar 22 to bite 60 between the rolls. Floor 38 and removable floor 56 extend on an arc around shaft 20 close to the cylinder generated by the cutterhead knives 24. The crop follows the path of knives 24 until the crop reaches floor 59, which bends away from the knives to bite 60. Floor 59 terminates at bite 60; it is interposed between the knives 24 and the surface of lower roll 52. As the crop reaches floor 59 it is discharged by centrifugal force and directed toward the bottom surface of upper roll 51 and the bite 60 of the two rolls.

In addition to feeding animals with corn kernels which have been cracked, the length of the fiber material fed to the animals is a factor. Some milk producers add hay roughage to the corn being fed. The amount of hay can be less if the corn is cut in long lengths such as one to one and a half inches long instead of a half inch or less. The finer the chop, the poorer the digestive process. The longer the fiber, the better the digestion. With corn processor 50, the surface of upper roll 51 traveling clockwise has a sweeping action on the crop being carried and delivered by knives 24, FIG. 4. Roll 51 is close enough to strip the corn crop from the knives and direct it into bite 60. The crop stripping action of the upper roll facilitates the transfer of the chopped crop for passage between the rolls, and enables the handling of longer chopped crop material.

The corn crop passing between rolls 51 and 52 is projected in an upper rearward direction against a deflector 62 having a downward and rearward section 64, a vertical wall section 65 and a downward and forwardly projecting ledge 66. These sections wrap around lower roll 52 in close proximity thereto. Roll 52 rakes the corn crop passing along deflector 62 and discharges the material into trough 26. See arrows 47 in FIG. 4 showing the path of the corn crop around cutterhead 19, through the rolls 51–52 and downwardly to auger 28.

As shown in FIG. 4, lower roll 52 is directly above auger 28 in a position to deflect downwardly any crop material throw upwardly and out of trough 26 by the auger. In such location lower roll 52 is in kernel cracking position with upper roll 51 and also in a position over auger 28 to engage and block crop thrown upwardly and out of trough.

Corn processor unit 50 has a vertical back wall 67 hinged at 68 to a frame element 69 of trough 26. Wall 67 can be swung to opened position to provide access to the removable floor section 56 around part of the cutterhead. When bolts 57 are removed and floor 56 is disconnected from floor section 59, floor 56 can be removed through the space between auger 28 and lower roll 51.

When floor 56 is removed, the harvester can be used to harvest hay and discharge the crop directly to trough 26 and auger FIG. 5, without passing through corn processing rolls 51 and 52. The harvester can be used to chop hay without removing corn processor unit 50. Only the floor 56 needs to be removed.

When corn is again to be harvested, floor 56 is returned to its position around cutterhead 18 and close to knives 24. The removable floor is secured in place by bolts 57 to floor section 59.

The bite 60 between the upper roll 51 and lower roll 52 is upwardly and rearwardly of a horizontal plane through the shaft 20 of cutterhead 19. When viewed as shown in FIG. 4, bite 60 is around a ten o'clock position relative to the cutterhead. Further, the diameter of the two rolls 51 and 52, including the space between them is generally comparable to the diameter of the cutterhead. Using large diameter corn processing rolls provides a strong stripping action to pull the delivered corn crop from the cutterhead.

With this design, the corn processor 50 can be installed in a pull-type harvester of the type described without major alterations of the base harvester machine. When hay is to be harvested, the operator merely removes floor 56. If desired, the entire corn processor unit can be removed from the harvester; or the unit can be left in place and only floor 56 removed for the harvesting of hay crops. The drive is also disconnected.

Figure 2:
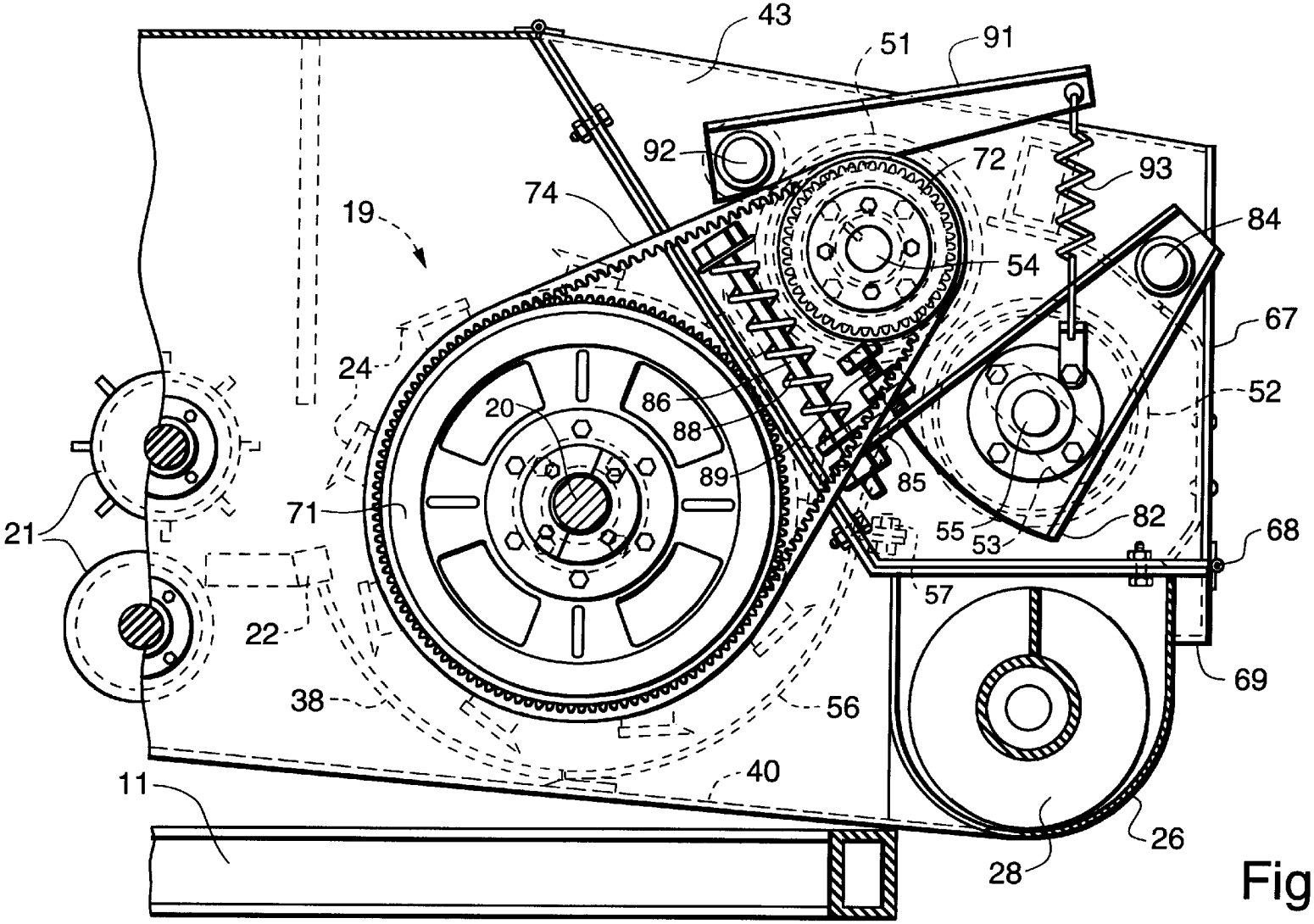
FIG. 2 is an enlarged side elevational view taken on the line 2—2 of FIG. 1 showing the corn processor and the drive thereto.
Figure 3:
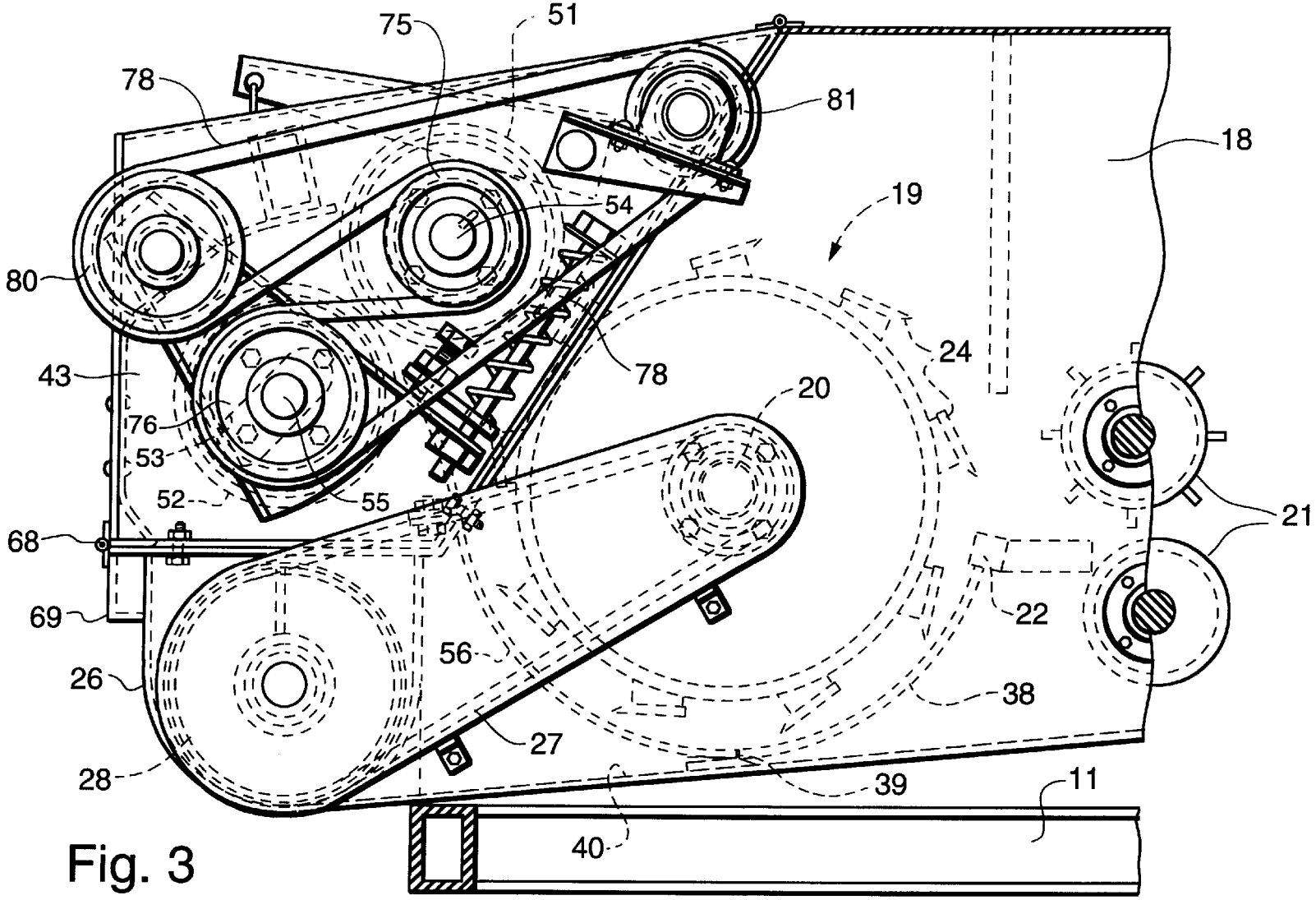
FIG. 3 is an enlarged side elevational view taken on the line 3—3 of FIG. 1 showing the side of the corn processor opposite FIG. 2 and the drive from the upper to the lower roll.

The drive to corn processor 50, FIGS. 1, 2 and 3, includes a large diameter sheave 71 on the inside end of cutterhead shaft 20, FIGS. 1 and 2. The upper roll 51 has a sheave 72 on the shaft 54 of the roll. Sheaves 71 and 72 are gear type, interconnected by a timing belt 74 having teeth on the inside which mesh with the teeth on the sheaves. The drive from gear box 35 through connections 36 to shaft 20 of cutterhead 19 is then through belt 74 to the inside end of shaft 54. The drive does not pass through cutterhead and then up to the upper roll 51 on the right or outside of the harvester.

To drive lower roll 52, the outside end of shaft 54 of upper roll 51 has a sheave 75 FIG. 3. The outside end of the shaft 55 of lower roll 52 has a sheave 76. Sheaves 75 and 76 are connected by an endless belt 78 which passes over idlers 80 and 81. The lower roll 52 is rotated in a direction opposite to the rotation of upper roll 51. When viewed as shown in FIGS. 4 and 5, the cutterhead 19 and upper roll 51 rotate clockwise and the lower roll runs counterclockwise. Located upwardly and rearwardly of cutterhead 19, the surface of the upper roll travels opposite to the path of knives 24, and being close to the path of knives 24, it strips the crop from it.

The take-away speed of the rolls 51 and 52 as corn enters bite 60 is greater than the speed at which the chopped corn is delivered by cutterhead 19. This pulls and strips the crop from the cutterhead and projects it against deflector 62. Also, lower roll 51 is driven at a somewhat lower speed than upper roll 52, a common feature when corn is processed through a roller mill.

Figure 6:
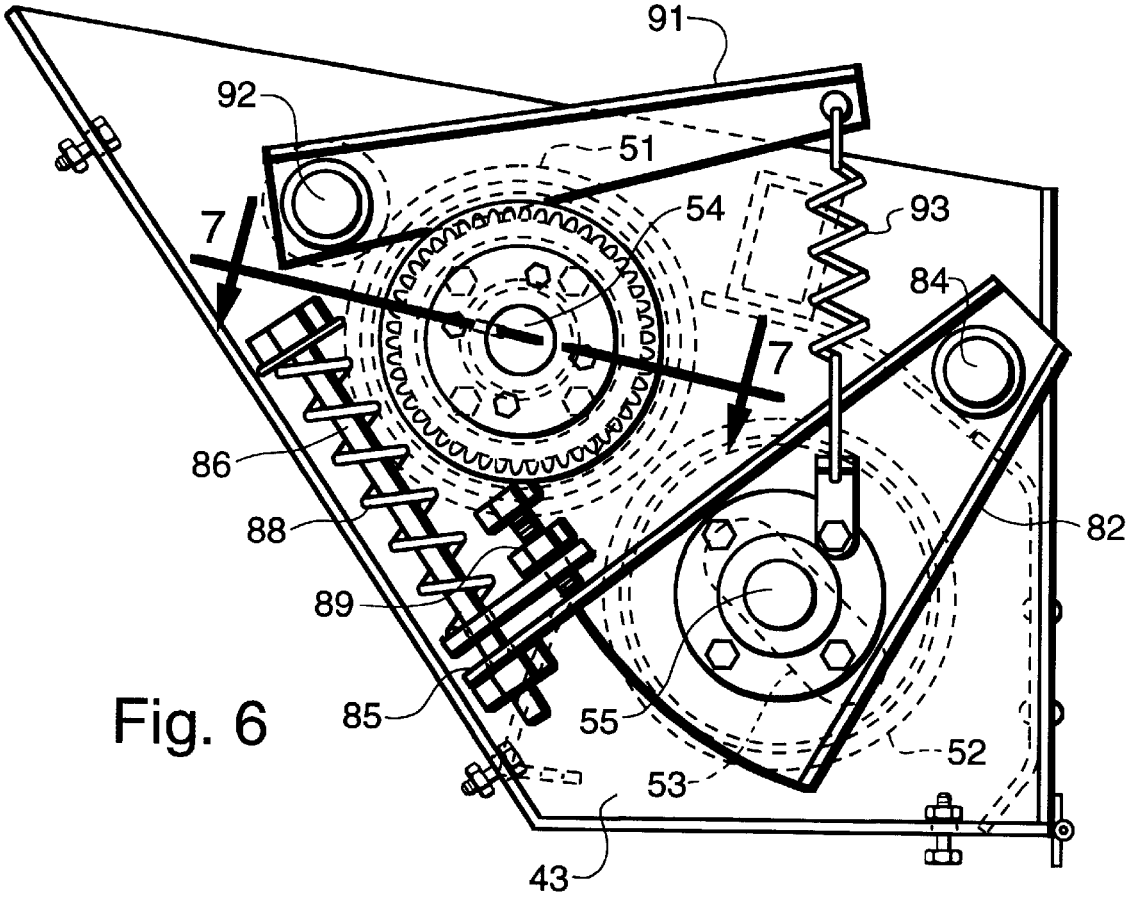
FIG. 6 is an enlarged side elevation of the corn processor unit, with its upper and lower rolls, removed from the harvester, the lower roll being spring loaded for movement relative to the upper roll and an adjustable stop being provided to limit movement of the lower roll.

The shaft 55 of lower roll 52 passes through slots 53 in side walls 43 of processor 50, FIG. 6. Roll 52 is supported on swing arms 82 pivoted at 84 on walls 43. An extension 85 of each arm 82 has a bolt 86 and spring 88 to yieldably resist movement of the lower 52 roll away from upper roll 51. Stops 89 are provided whereby the spacing of the rolls from each other can be set. Hanger arms 91 pivoted at 92 provide a spring 93 support for the lower roll. With this structure the normal operating position of rolls 51 and 52 is set by stops 89. When a feed overload occurs by the corn crop passing between the rolls, lower roll 52 can move a limited amount relative to upper roll 51.

Figure 7:
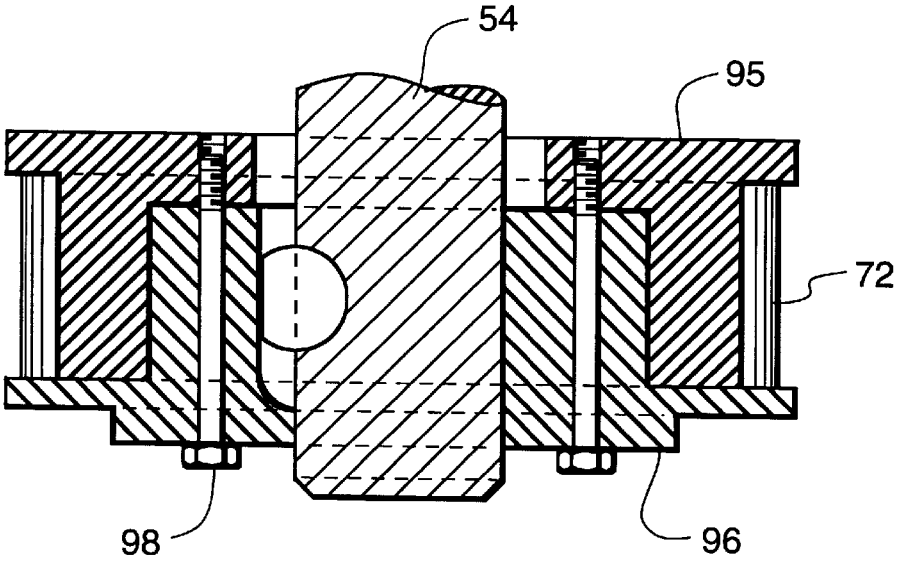
FIG. 7 is a detail section taken on the line 7—7 of FIG. 6 showing a two part drive sheave for the upper corn processor roll which is severable to permit removal of the timing belt drive when the corn processor is not in use.

When the harvester is to be used to harvest hay crops, with the hay passing downwardly and rearwardly of the cutterhead 19 as shown in FIG. 5, the drive to corn processor 50 is disconnected in addition to removing floor 56. FIG. 7 shows how sheave 72 is connected to shaft 54. Sheave 72 has two parts 95 and 96 interconnected by bolts 98. If the operator is to harvest hay and leave the corn processor on the machine, sheave 72 to the upper roll is removed. This permits the timing belt 75 to be disconnected from sheave 71 and the removal of sheave 71 from its connection to cutterhead shaft 20.

With this structure, corn processor 50 can be installed as a kit on previously used harvesters of the type described, or it can be incorporated with new harvesters as an option or standard equipment. The farmer can selectively harvest hay crop, using the arrangement as shown in FIG. 5, or he can harvest corn crop and crack the corn kernels as shown in FIG. 4. The relationship of the processor rolls to the cutterhead knives and the positioning of the bite in a location around ten o'clock provides a direct transfer of the crop to the bite 60. With the surface of upper roll 51 in the path of the corn crop coming from the cutterhead, roll 51 has a stripping action relative to knives 24. Lower roll 52, in addition to cracking the corn kernels with upper roll 51 is positioned over auger 28 in trough 26. If the flights of auger 26 throw material upwardly and out of the trough, the bottom surface of the lower roll sweeping forwardly and away from the rear of the harvester blocks the upward movement of the crop and assists the auger in holding down the processed corn crop as it is transported to the discharge blower.

When the structure described is used for hay and the drive to the corn processor is disconnected, the lower rolls remains to block material thrown upwardly by auger 28.

Although this corn processor kit 50 has been described in a particular preferred embodiment thereof, it is understood that modifications of the design are possible without departing from the scope of this invention and the operation of the unit.

Having thus described our invention, what we claim is:

1. In a pull type forage harvester for hay, corn and other crop material, a frame mounted on wheels for forward travel in a field to gather crops, a housing on said frame having a forward opening, a shear bar over which crop material passes as the material enters said housing through said opening, a cutterhead in said housing and mounted thereon for rotation on an axis transverse to said forward travel, a transverse generally horizontal trough located downwardly and rearwardly of said cutterhead axis, a conveyor in said trough, means to receive chopped crop material from said trough and discharge it from the harvester, a series of knives on said cutterhead having cutting edges which travel in a circular path generating a cylinder and copperative with said shear bar to chop crop material fed into said housing, means rotatably driving said cutterhead whereby said knives travel downwardly and forwardly toward said shear bar and then downwardly and rearwardly toward said trough, a band around the cutterhead extending between the shear bar and a location below a lower portion of the cutterhead, the improvement comprising:

a corn processor having a removable floor mountable on said housing around part of said cutterhead and extending from the lower end of said band to an upper terminal end, upper and lower corn processor rolls mounted on axes generally parallel to said cutterhead axis and defining between them a bite to receive chopped corn conveyed by the cutterhead over said floor, said upper and lower rolls having surfaces spaced from each other so that kernels of corn passed between them are cracked by the rolls, the surface of said upper roll being close to and in crop stripping relation to said circular path of travel of said cutterhead knives, said lower roll being so located above said trough and the conveyor therein that it deflects downwardly chopped corn thrown upwardly from the trough and having a surface located from said knives to form a passage for crop material, means on said harvester for driving the cutterhead and said upper roll in the same direction of rotation and driving said lower roll in an opposite direction, the speed of said rolls projecting processed corp crop therefrom, and a deflector mounted on the harvester in the path of processed corn discharged from between said processor rolls, said deflector extending to direct processed corn downwardly behind said lower roll and into said trough beneath the lower roll.

2. A harvester as recited in claim 1 wherein the bite between said upper and lower corn processor rolls is upwardly of a horizontal plane through the axis of rotation of said cutterhead.

3. A harvester as recited in claim 1 wherein the diameters of the upper and lower corn processor rolls including the space between the rolls has a total distance similar to the diameter of the cutterhead.

4. A harvester as recited in claim 1 wherein said removable floor has two sections, an arcuate section which extends from beneath said cutterhead to an upper end behind the cutterhead, and a guide section which extends from said upper end of the arcuate section to a terminal edge toward said bite between said upper and lower processor rolls, said arcuate section having the same curvature as the path of the knives on the cutterhead.

5. A harvester as recited in claim 4 wherein said guide section of said floor is between the travel of the knives on the cutterhead and the surface of said lower processor roll whereby chopped corn is directed by the guide section toward the surface of the upper processor roll, tangentally to the surface of the lower roll, and into the bite between the rolls.

6. A harvester as recited in claim 5 wherein said upper roll has a faster surface speed than the lower roll to facilitate the travel of chopped corn into the bite between the rolls and through the cooperating rolls to crack the kernels passing between the rolls.

7. A harvester as recited in claim 4 wherein the arcuate section and the guide section of said removable floor are in two separate pieces, means being provided to detachably connect the upper end of the arcuate section to the lower end of the guide section to provide a continuous floor from the band around the cutterhead to the roll bite.

8. A harvester as recited in claim 7 wherein said arcuate section can be removed and the guide section left in place, chopped crop material going directly into said trough when the arcuate section is removed, and onto the roll bite when such section is in place between the band and the guide section.

9. A harvester as recited in claim 1 wherein said deflector extends downwardly and rearwardly from said upper roll in close proximity to said lower roll, and then downwardly behind the lower roll and downwardly and forwardly toward said trough, whereby the lower roll rakes the processed corn along the deflector and into the trough.

10. A harvester as recited in claim 9 wherein said deflector is attached to a rear cover pivoted on the harvester whereby the deflector can be swung to an opened position to provide access to the arcuate section of the removable floor so that such arcuate floor section can be taken out to allow chopped crop to travel directly to said trough and not between said processor rolls.

11. A harvester as recited in claim 1 wherein said lower processor roll above said trough and the conveyor operable therein is located so that if crop material is thrown upwardly and out of the trough the lower roll will block such movement and assist in holding the crop in the trough.

12. A harvester as recited in claim 1 wherein the drive means on the harvester to the cutterhead includes a power-take-off to a shaft on the cutterhead, the end of the cutterhead shaft to the inside left of the cutterhead facing forwardly has a sheave and the inside end of said upper roll has a shaft and sheave, these sheaves being interconnected by an endless drive element, said upper roll shaft crossing to the right side of the harvester housing facing forwardly, belt and sheave means being provided on the outside of the upper roll shaft to drive said lower roll.

13. A harvester as recited in claim 12 wherein the drive to the upper roll from the inside end of the cutterhead shaft is at one speed and the drive from the outside of the upper roll shaft to the lower roll is at a slower speed, whereby the difference in roll speeds facilitates the cracking of corn kernels passed between the rolls.

14. A harvester as recited in claim 13 wherein the drive element between the cutterhead and upper shaft has inside teeth which engage in gear slots in the drive sheaves whereby a non-slip drive to the upper roll is provided.

15. A harvester as recited in claim 12 wherein the power-take-off drive to the cutterhead has a coupler to separate the drive whereby the sheave drive between the cutterhead and the upper roll can be disconnected when corn processing is not to be employed.

16. In a pull type forage harvester which travels forwardly to pick up crop material and feed it to a cutterhead rotatable on a transverse axis and having knives which chop the crop material, a transverse trough having a conveyor into which material is delivered from the cutterhead for lateral conveyance into a blower which discharges the crop into a trailing wagon, the improvement being a corn processor comprising:

a removable floor surrounding said cutterhead from an end adjacent a lower portion of the cutterhead to an upper terminal end rearwardly of the cutterhead, the knives on the cutterhead conveying chopped corn material over said floor and discharging the material beyond said terminal end of the floor, an upper and a lower roll rotatable on axes parallel to each other and to the axis of rotation of the cutterhead, means mounting said rolls close to the knives on said cutterhead, said rolls forming a bite to receive material discharged from said floor, said rolls having aggressive surfaces spaced apart such a distance that kernels of corn passed between them are cracked, said upper roll having a bottom surface in the path of crop material from the cutterhead and in such proximity to the travel of the cutterhead knives that the upper roll strips material from the knives and feeds it into said bite between the two rolls.

17. In a pull type forage harvester as recited in claim 16 in which the space between the cutterhead knives and said lower surface portion of said upper roll is less than the radius of the upper roll.

* * * * *